United States Patent [19]

Eshleman et al.

[11] 4,070,080

[45] Jan. 24, 1978

[54] CIRCULAR CONNECTORS

[75] Inventors: Barden E. Eshleman; George S. Johnson, both of Canoga Park, Calif.

[73] Assignee: Viking Industries, Inc., Chatsworth, Calif.

[21] Appl. No.: 755,090

[22] Filed: Dec. 27, 1976

[51] Int. Cl.[2] ..... H01R 13/54

[52] U.S. Cl. ..... 339/91 R; 339/184 M

[58] Field of Search ..... 339/91 R, 75 M, 176 M, 339/12 B, 89 R, 89 M, 184 M, 176 S

[56] References Cited

U.S. PATENT DOCUMENTS

| | | | |
|---|---|---|---|
| 3,133,777 | 5/1964 | Anhalt | 339/91 R |
| 3,484,736 | 12/1969 | Wyse | 339/91 R X |
| 3,697,928 | 10/1972 | Hammell | 339/91 R X |
| 3,824,523 | 7/1974 | McGhee | 339/91 R X |
| 3,880,487 | 4/1975 | Goodman et al. | 339/91 R X |
| 3,953,099 | 4/1976 | Wilson | 339/184 M X |

*Primary Examiner*—Joseph H. McGlynn
*Assistant Examiner*—E. F. Desmond
*Attorney, Agent, or Firm*—Charles H. Schwartz

[57] ABSTRACT

An electrical connector including a plug member having a body portion including openings for receiving first contact members and an outer shell surrounding and spaced from the body member, a receptacle member having a body portion including openings for receiving second contact members corresponding to and mating with the first contact members and with the receptacle including a shell portion extending from the body portion and with the shell portion of the receptacle received within the space between the outer shell and the body portion of the plug when the plug and receptacle are mated, the outer shell of the plug including at least one internal tab and with the thickness of the outer shell increased in the area of the internal tab, the shell portion of the receptacle including at least one undercut portion on the outer surface and with the undercut portion including a front face extending across the undercut, and the internal tab locking in the undercut portion at the front face when the plug and receptacle are mated.

8 Claims, 7 Drawing Figures

CIRCULAR CONNECTORS

The present invention is directed to a low-cost miniature circular connector having a one piece design and being formed from thermoplastic material. This type of connector provides for a high strength to weight ratio with high impact durability.

Miniature connectors of the type provided for in the present invention may be used in a wide variety of commercial and military applications. For example, the low-cost light weight connectors of the present invention offer the general advantages of non-corrosion, quick connect/disconnect and high density contact arrangements which provide for miniaturization.

Generally the connectors of the present invention are relatively rugged and durable and can withstand high vibration and shock. The connectors may provide for high density contact arrangements and include a positive polarization between the plug and receptacle portions of the connector. The connectors of the present invention provide for quick connect/disconnect yet provide for a reliable locking while connected.

The connectors of the present invention include a plug portion and a receptacle portion. The plug portion normally includes openings for receiving a plurality of socket contacts and with the openings arranged in a particular configuration to provide for simplicity in inserting the socket contacts in the openings in the proper order. The receptacle portion also includes openings for receiving a plurality of pin contacts and with the configuration of the openings for the pin contacts arranged in a complementary fashion to that of the openings in the plug to provide for the same simplicity of insertion of the pin contact in the proper order the pin contacts are received in the socket contacts when the plug and receptacle portions are mated.

The present invention includes an improved locking structure wherein the plug portion includes a shell portion having an internal locking tab which mates with an undercut portion on the receptacle so that the undercut portion receives and retains the locking tab. The undercut portion may have a beveled front edge so as to provide for easier disengagement of the plug from the receptacle. The locking tab may be located at the open end of the shell portion and with the shell portion having a thickened wall portion in the area of the tab so as to prevent breakage. In addition, the internal tab is normally located at the end of a cutout portion through the shell and with the corners of the cutout portion rounded off to prevent splitting.

In one form of the invention, the front edge of the undercut has a right angle to provide for a positive lock but with the front edge extending completely across the undercut portion. In this embodiment of the invention, the internal locking tabs are provided with the thickened wall portion for the shell and with the remaining wall portions of the shell being flexible so as to provide for distortion of the shell to facilitate a disengagement of the plug from the receptacle. In another form of the invention the front edge of the undercut includes a beveled front edge so that the plug may be disengaged from the receptacle by pulling the plug and receptacle apart. However, disengagement may be facilitated by distorting the shell to disengage the tab from the undercut.

A clearer understanding of the invention may be had with reference to the following description and drawings wherein FIG. 1 shows an exploded view of a first embodiment of a circular connector constructed in accordance with the teachings of the present invention;

Figure 1:
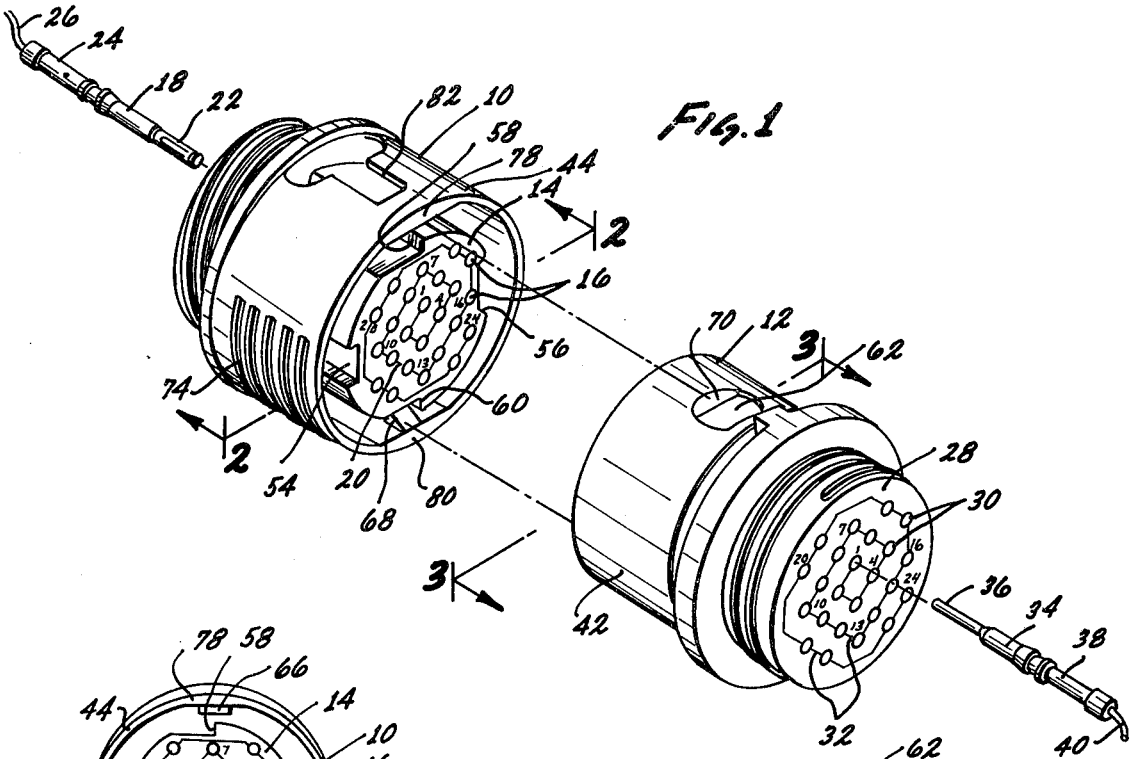
Figure 2:
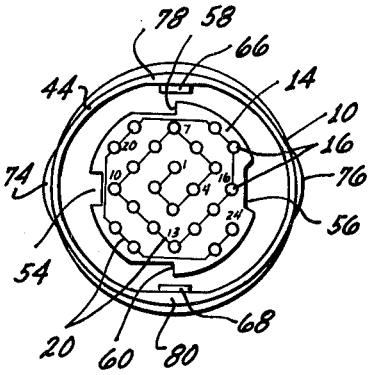
FIG. 2 illustrates a view of the plug portion of the connector of FIG. 1 taken along lines 2—2.

FIGS. 1 through 4 show a first embodiment of the invention including a plug 10 and a receptacle 12 which mate together to form a complete circular connector. The plug 10 includes a central body portion 14 having a plurality of openings 16 which extend through the body portion 14 and with each opening receiving a socket contact member 18, one of which is shown for illustrative purposes. It is to be appreciated that a plurality of such contact members 18 may be used corresponding in number to the number of openings 16 in body portion 14. It can be seen that the openings 16 are arranged in vertical rows of alternating three openings and four openings to provide for a total of twenty-four such openings 16. The pattern of the adjacent rows of openings therefore increase and decrease by one. In order to facilitate the insertion of the contacts 18 into individual ones of the openings 16, the pattern of openings 16 may proceed from a first opening designated "1" and along a path shown by line 20. The pattern generally forms a spiral configuration which intercepts all 24 of the openings 16. It can be seen that the contacts may be inserted one at a time starting with the contact opening in the central position designated "1" and radiating outward so that each opening 16 may be filled in turn with a contact 18 and in a logical orderly progression.

The socket contact 18 has socket portion 22. The end of the contact 18 opposite the socket portion 22 is formed as a wire contact area 24 to receive a wire 26 such as by crimping or soldering the wire 26 within the wire contact portion 24.

The receptacle 12 includes portions which are complementary to portions of the plug 10. Specifically the receptacle 12 includes a body portion 28 which has a plurality of openings 30 which are complementary to the openings 16. The openings 30 are formed in a pattern corresponding to the pattern of openings 16 formed in the body portion 14. Specifically, the openings 30 are formed in a pattern shown by the line 32 which is substantially identical to the line 20 and which line 32 intercepts all of the openings 30 to form a spiral path. Each opening 30 receives a contact 34 which may be a pin contact and includes a pin portion 36. Each pin portion would mate with the socket portion 22 of the socket contact 18 when the plug 10 and receptacle 12 are mated. The contact 34 may also include a wire receiving portion 38 which receives a wire 40 such as by crimping or soldering the wire 40 within the wire receiving portion 38.

Figure 3:
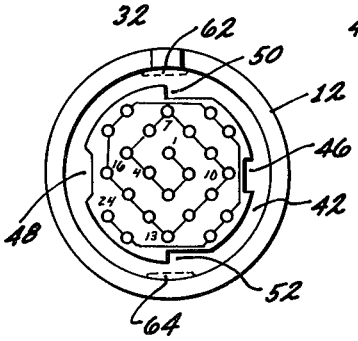
FIG. 3 illustrates a view of the receptacle portion of the connector taken along lines 3—3 of FIG. 1.

The receptacle 12 also includes a shell portion 42 and with the pin contacts 34 when inserted through the openings 30 disposed within the shell portion 42. The shell portion 42 of the receptacle 12 is mated within a shell portion 44 of the plug 10. The shell portion 44 has an inner diameter larger than the outer diameter of the shell portion 42. The shell portion 42 has its inner surface shaped to form key portions 46, 48, 50 and 52 as shown in FIG. 3, which extend inwardly. The key portions 46, 48, 50 and 52 cooperate with corresponding keyways 54, 56, 58 and 60 which keyways are formed in the body portion 14. Therefore the plug 10 and receptacle 12 when mated are always positively aligned so that the proper contact is made between the pin contacts 34 and the socket contacts 18.

In order to provide for the locking between the plug and the receptacle portions of the connector of the present invention, a locking mechanism is provided including undercut portions 62 and 64 in the shell portion 42 of the receptacle 12 and locking tabs 66 and 68 extending from the inner surface of the shell portion 44 of the plug 10.

Figure 4:
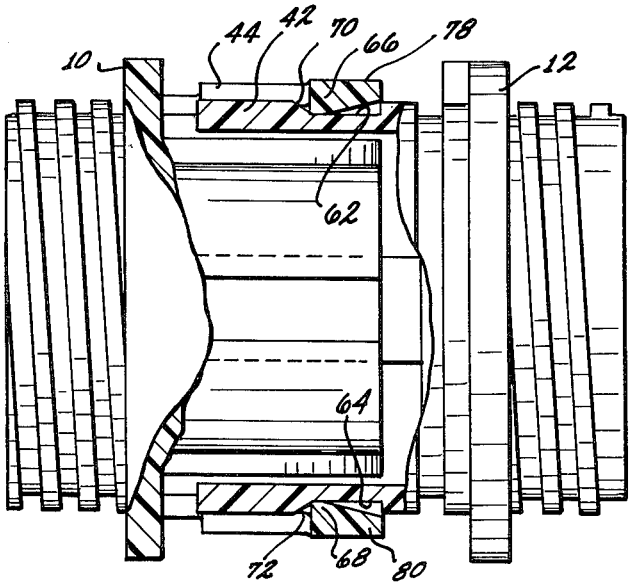
FIG. 4 illustrates a side partially cross-sectional view of the connector of FIG. 1 showing the locking of the plug and receptacle.

It can be seen that the undercut portion such as the undercut portion 62 includes a front edge 70 which is tapered and which extends completely across the undercut portion. The undercut portion 64 has a similar tapered front edge 72 as shown in FIG. 4. The use of the tapered front edge of the undercut portions allows for the locking of the tabs in the undercut portions but provides for a relatively easy disengagement of the plug from the receptacle by merely pulling the plug and receptacle away from each other. In order to facilitate the disengagement of the plug from the receptacle, the shell 44 may be squeezed together such as at positions 74 and 76. The squeezing provides for a flexing of the tabs 66 and 68 outwardly to disengage the undercut portions.

In order to ensure that the shell 44 will not break as it is flexed during the locking and disengagement of the tabs, the wall portion of the shell 44 in the area of the tabs 66 and 68 is thickened such as shown at positions 78 and 80. In addition, the area behind the tabs is relieved as shown by cutout opening 82 and with a corresponding opening behind tab 68. In order to ensure that the flexing of the shell 44 will not provide breakage, all of the corners of the cutout 82 are radiused so as to eliminate any sharp corners.

The embodiment of FIGS. 1 through 4 therefore provides for a positive locking of the plug and receptacle but with a relatively simple disengagement due to the tapered front edges of the undercut. The front edges extend across the undercuts to ensure the locking of the tabs in the undercuts. The wall thickness in the area of the tabs is thickened and the cutout behind the tabs has its corners radiused so as to eliminate cracking and breakage of the shell portion of the plug member during locking and unlocking.

Figure 5:
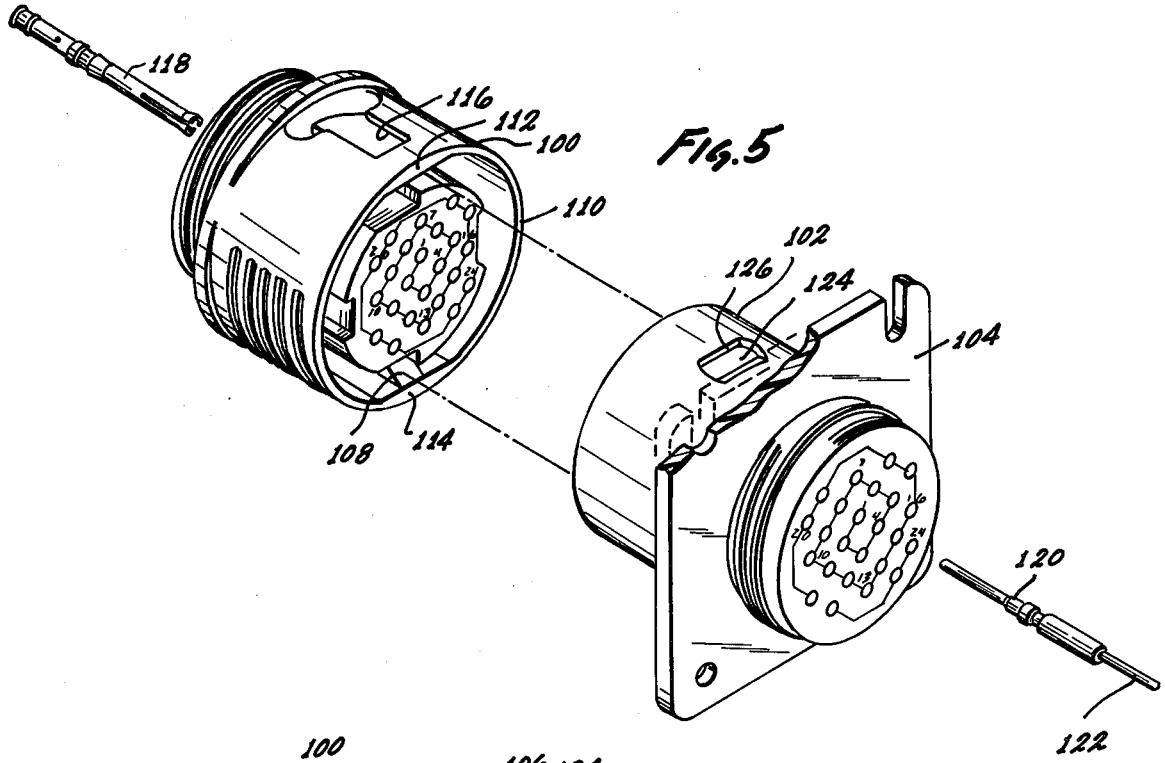
FIG. 5 illustrates an exploded view of a second embodiment of the invention including a mounting flange on the receptacle portion of the connector.
Figure 6:
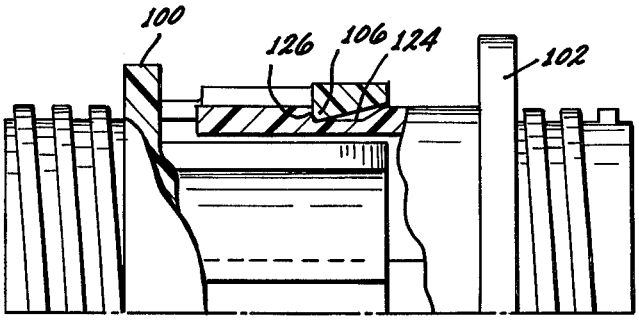
FIG. 6 is a side partially cross-sectional view of the connector of FIG. 5 showing the locking between the plug and connector.

FIGS. 5 and 6 show a second embodiment of the invention including a plug 100 and a receptacle 102 and with the receptacle including a flanged portion 104 for use in mounting the receptacle member. The plug member 100 is similar to the plug member 10 shown in FIGS. 1 through 4 and includes the use of a tab member 106 shown in FIG. 6 and a corresponding tab member 108 shown in FIG. 5, both of which tab members extend inwardly from a cylindrical shell 110. The wall portions 112 and 114 in the area of the tabs are thickened to prevent breakage. In addition, cutout openings behind the tab members such as opening 116 include radiused corners, again to eliminate breakage as the shell portion of the plug member is flexed during locking and unlocking of the plug member 108 with the receptacle 102.

In FIG. 5 the plug member is seen to receive a socket contact 118 of a slightly different form than that shown in FIG. 1 but which performs essentially the same functions as that shown in FIG. 1. However, in FIG. 5 a pin contact 120 is shown for use with the receptacle 102. The pin contact 120 includes an end portion 122 which may be used to directly mount the receptacle on a board member such as a printed circuit board (not shown). For example, the end portion 122 of the contact 120 may extend through the printed circuit board and with the receptacle 102 held against the printed circuit board by use of the flange 104. The end portion 122 of the contact 120 may be directly soldered to contact areas on the printed circuit board.

The receptacle 102 includes an undercut locking portion 124 which has a squared-off front edge portion 126 to receive a corresponding edge portion of the locking tab 106. It is to be appreciated that a similar undercut is present on the opposite side of the receptacle 102 to mate with the locking tab 108. The front edge portion 126 extends completely across the undercut portion to ensure a positive locking with the locking tab 106 over the edge portion of the locking tab 106. The embodiment of FIGS. 5 and 6 provides for a more positive locking than that provided by the embodiment of FIGS. 1 through 4 but the plug must be disengaged by squeezing the plug portion together to spread the locking tabs 106 and 108 apart and out of engagement with the undercut portions in the receptacle 102. The thickening of the portions 112 and 114 and the rounding off of any cutoff portions ensures that this squeezing will not provide for breakage during the locking and unlocking of the plug member 100 and the receptacle 102.

Figure 7:
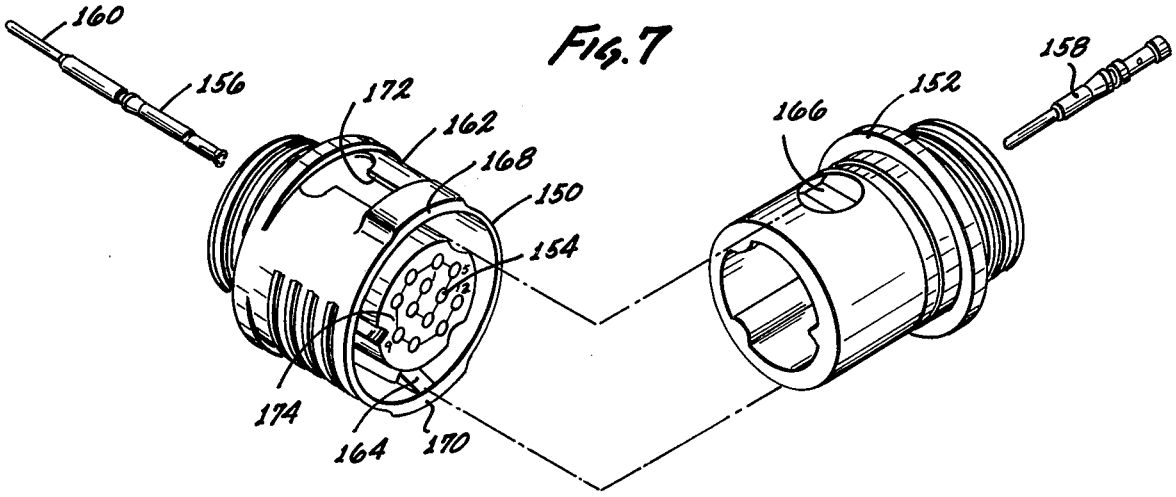
FIG. 7 illustrates an exploded view of a third embodiment of the invention of a smaller size than the previous embodiments of the invention and with a smaller number of contacts.

FIG. 7 illustrates a third embodiment of the invention including a plug member 150 and a receptacle 152 and with both the plug and receptacle being of relatively small size. The connector of FIG. 7 includes only twelve openings 154 through the plug and with a corresponding number of openings in the receptacles. The plug 150 receives socket contact members 156 in the openings in the plug and pin contact members 158 are received in openings in the receptacles 152. In FIG. 7 the socket contact member 156 includes a pin portion 160 which may be used to plug the pin portions 160 of the plug member 150 into a board such as a printed circuit board.

In the embodiment of the invention as shown in FIG. 7, a shell portion 162 of the plug member 150 includes two locking tabs such as illustrated by the single locking tab 164. The locking tabs lock into undercut portions such as illustrated by the single undercut portion 166. The undercut portion 166 may have a front edge either tapered or squared off as shown in the embodiments of the invention previously described. In order to prevent cracking of the shell 162 of the plug member 150 during flexing of the plug member when locking and unlocking the plug member with the receptacle 152, the area of the shell 162 adjacent the locking tabs is thickened as shown at positions 168 and 170. In addition, any cutout area behind the locking tabs such as locking tab 164 has its corners radiused as shown by cutout portion 172. This ensures for positive locking of the plug member with the receptacle and eliminates cracking and breaking of the plug member.

It is to be noted that the embodiment of the invention shown in FIG. 7 includes a smaller number of openings 154, and therefore contacts, than the previous two embodiments of the invention, but the layout of the openings follows the same general pattern as that disclosed before. Specifically adjacent rows of openings 154 increase and decrease by one so as to provide for a pattern of openings 154 which follows a generally helical path radiating from a central position as shown by line 174. In this way, the contacts such as contact 156 may be inserted in the openings in a logical order starting from a central position and radiating outward. The receptacle member 152 has a corresponding layout of openings to receive the pin contacts 158.

The various embodiments of the invention show threaded portions at the extremities of the plugs and receptacles. It is to be appreciated that these threaded portions may receive various types of backshell members to contain and lock the wires extending from the plug and/or receptacles and that these backshell members may take various forms as shown in the prior art. It is also to be appreciated that various contact patterns may be used having greater or lesser number than that shown in the present invention but generally the pattern having adjacent rows of openings increasing and decreasing by one in number so as to provide for an outwardly radiating pattern of contact insertion is to be preferred.

Although the invention has been described with reference to particular embodiments, it is to be appreciated that various adaptations and modifications may be made and the invention is only to be limited by the appended claims.

We claim:

1. An electrical connector including a plug member having a body portion including openings for receiving first contact members and an outer shell surrounding and spaced from the body member, a receptacle member having a body portion including openings for receiving second contact members corresponding to and mating with the first contact members and with the receptacle including a shell portion extending from the body portion and with the shell portion of the receptacle received within the space between the outer shell and the body portion of the plug when the plug and receptacle are mated, the outer shell of the plug including at least one internal tab and with the thickness of the outer shell increased in the area of the internal tab and including a cutout area behind the internal tab and with all corner portions of the cutout area radiused, the shell portion of the receptacle including at least one undercut portion on the outer surface and with the undercut portion including a front face extending across the undercut, and the internal tab locking in the undercut portion at the front face when the plug and the receptacle are mated.

2. The electrical connector of claim 1 wherein the front face of the undercut portion is beveled to facilitate unlocking.

3. The electrical connector of claim 1 additionally including a second internal tab and corresponding undercut portion located at a position 180° from the first internal tab and undercut portion.

4. The electrical connector of claim 1 wherein the openings in the plug and receptacle members for receiving the contact members are arranged in a row pattern wherein adjacent rows of openings increase and decrease by one opening and the openings in each row are staggered from the openings in the adjacent rows.

5. An electrical connector, including, a plug member and a complementary receptacle member each including openings for receiving contact members which mate with each other, the plug and receptacle members each including shell portions and with one shell portion received within the other shell portion, the one shell portion including at least one undercut portion on its outer surface and with the undercut portion having a front face extending across the undercut portion, and the other shell portion including at least one internal tab for mating with the undercut portion to lock the plug and receptacle together and with the wall of the other shell portion thickened in the area of the internal tab and including a cutout area behind the internal tab and with all corner portions of the cutout area radiused.

6. The electrical connector of claim 5 wherein the front face of the undercut portion is beveled to facilitate unlocking.

7. The electrical connector of claim 5 additionally including a second internal tab and corresponding undercut portion located at a position 180° from the first internal tab and undercut portion.

8. The electrical connector of claim 5 wherein the openings in the plug and receptacle members for receiving the contact members are arranged in a row pattern wherein adjacent rows of openings increase and decrease by one opening and the openings in each row are staggered from the openings in the adjacent rows.

* * * * *